US006279781B1

(12) United States Patent
Konar

(10) Patent No.: US 6,279,781 B1
(45) Date of Patent: Aug. 28, 2001

(54) BOXED LIQUID DRIP CATCHER

(76) Inventor: Ronald C. Konar, 5743 W. Asbury Pl., Lakewood, CO (US) 80227

( * ) Notice: Subject to any disclaimer, the term of this patent is extended or adjusted under 35 U.S.C. 154(b) by 0 days.

(21) Appl. No.: 09/499,263

(22) Filed: Feb. 7, 2000

(51) Int. Cl.[7] ..... B67D 1/16
(52) U.S. Cl. ..... 222/108; 137/312
(58) Field of Search ..... 222/108, 571; 137/312, 313; 141/88

(56) References Cited

U.S. PATENT DOCUMENTS 457,458 * 8/1891 Britton et al. ..... 222/108
1,703,284 * 2/1929 Wolfe ..... 222/108
2,696,091 * 12/1954 Bueno ..... 222/108
3,199,820 8/1965 Thomson et al. .
3,240,384 3/1966 Lermer .
3,317,167 5/1967 Becker et al. .
4,216,598 8/1980 Newbert .
5,339,872 8/1994 Marino .
5,470,011 11/1995 Jordan .
5,690,138 * 11/1997 Fuller ..... 137/312

* cited by examiner

*Primary Examiner*—Philippe Derakshani
(74) *Attorney, Agent, or Firm*—Dorsey & Whitney LLP

(57) ABSTRACT

A device that attaches to a pouring spout used on a bag-in-the-box liquid container, the device having a reservoir to catch and contain any liquid drips from the spout spigot valve after valve operation. The device may have a chute to direct drips into the reservoir.

8 Claims, 5 Drawing Sheets

BOXED LIQUID DRIP CATCHER

BACKGROUND OF THE INVENTION

1. Field of the Invention

This invention relates to a device that attaches to a pouring spout used on bag-in-the-box liquid containers and catches and contains any liquid drips leaking from the spout.

2. Description of the Prior Art

Bag-in-the-box structures for liquids such as wines, milk, fruit juices, water, and other liquids, have an inner bag, often made of plastic positioned inside a box, often made of cardboard or plastic. A factory-installed spout with a spigot valve is attached to the bag and extends through the box, generally at the bottom end of a sidewall of the box, which directs the liquid from the box into portable containers used for consumption of the liquid. The spout includes an integral, normally closed spigot valve, as is known in the art. An opening in the spout directs flowing fluid generally downwardly. When the spigot valve is activated, liquid flows into the nozzle and passes generally downwardly into the portable container. These boxed liquid containers are generally described in U.S. Pat. Nos. 3,400,866 and 5,074,441.

The spout and spigot valve in these box containers are constructed from elastomers that seal by compression of elastomer surfaces. These elastomers are less resilient in cool temperatures. Boxed-liquid containers are typically cooled by refrigeration during storage, thus resulting in lower resiliency and less sealing force. Thus, drips may occur during use and as a result of repeated valve opening and closing. The drips flow from the spigot valve into the spout and then out of the spout onto the floor or surface below the box, creating a mess. Dripping is an undesirable loss of fluid and produces undesirable wet surfaces or puddles.

The instant invention was created with the shortcomings of the liquid-in-a-box spigot valves in mind.

SUMMARY OF THE INVENTION

The present invention attaches to a boxed liquid container spout, and catches and stores the dripping from the spout and valve. The liquid can be easily emptied from the device, and is conveniently stored in-position on the box container. In more detail, the invention is a device that attaches to the spout typically used in bag-in-the-box fluid containers to catch and contain liquid drips from the spigot valve operation or valve leakage. An upper mounting section attaches around the outer surface of the fluid discharge spout and extends below the spout, with a reservoir at the lower end to catch and contain liquid drips. The mounting section may have a chute or trough to direct the drips into the reservoir. The reservoir can be cup shaped, and attaches to the lower end of the mounting section and is positioned below the spout to catch and contain the liquid drippings.

The upper mounting section on the spout has an opening that fits closely over the spout. The opening may be a slot permitting positioning of the drip catcher on the spout. A second larger opening connected to the slot may be used for placing the invention on the spout. The large opening passes over the spout and the smaller opening is then closely positioned above the spout and then slid downwardly to contact the sides of the spout.

The reservoir is preferably located at a distance from and directly under the spout to permit portable containers to be placed directly under the spout without interference from the drip catcher.

The device is designed to be rotated at least 90 degrees to empty collected liquid drippings without removing the drip catcher from the spout. Rotating the drip catcher 180 degrees, a position directly above the spout, permits boxed liquid storage in refrigerators or shelves without removal of the liquid drip catcher.

The device may be permanently attached to a spout or can be a separate device that can be easily attached or removed.

Accordingly, an object of the present invention is to provide a removable drip catcher for boxed liquid containers that collects liquid leaking from the spout.

Another object of the invention is to provide a drip catcher that is attached to a boxed liquid container that collects the drips in a reservoir.

Another object of the invention is to provide a drip catcher that does not interfere with filling of portable containers under the boxed liquid containers.

Another object of the invention is to provide a drip catcher that remains on the spout when emptying or when the boxed liquid container is stored.

A more complete appreciation of the present invention and its scope can be obtained from the accompanying drawings, which are briefly summarized below, the following detailed description of the presently preferred embodiments of the invention, and the appended claims.

DETAILED DESCRIPTION OF THE PREFERRED EMBODIMENT

Figure 1:
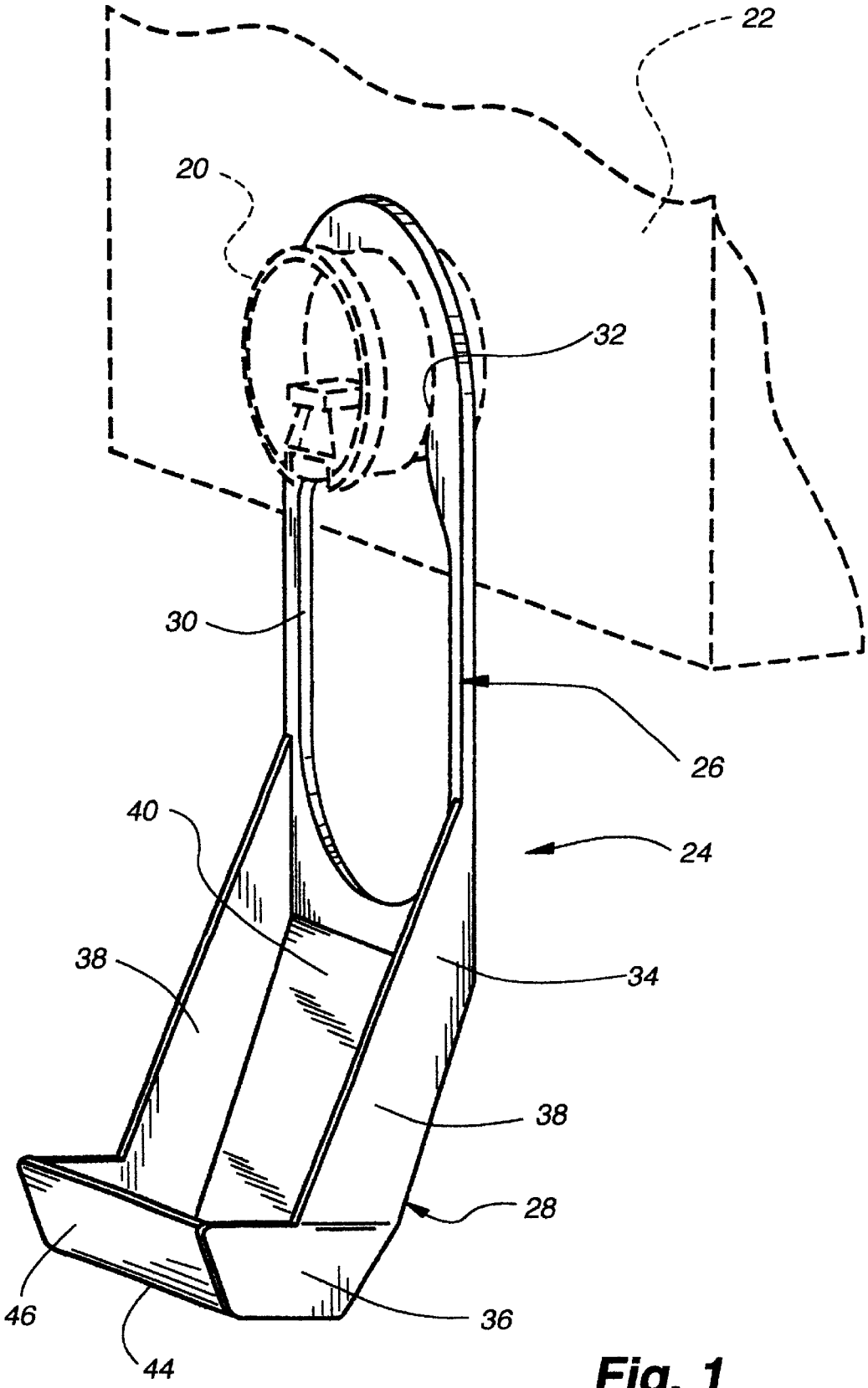
FIG. 1 is a perspective view of the drip catcher mounted on a boxed liquid container spout.

Referring first to FIG. 1, an embodiment of the invention is shown depending from a spout 20 formed on a boxed liquid container 22. The boxed liquid container is not part of the invention. Normally, the spout 20 is constructed from elastomeric materials, and contains a valve also constructed from elastomeric material that opens with lifting pressure allowing the liquid to flow through an opening in the spout. The liquid catcher 24 hangs from the spout and is suspended in a position below the spout to collect drips therefrom.

The liquid drip catcher 24 shown in FIG. 1 includes a hanger structure 26 for attaching the drip catcher to the spout, and a reservoir structure 28 connected to the bottom end of the hanger structure 26, the reservoir structure 28 for catching and storing the liquid drips from the spout of the boxed liquid container.

Figure 2:
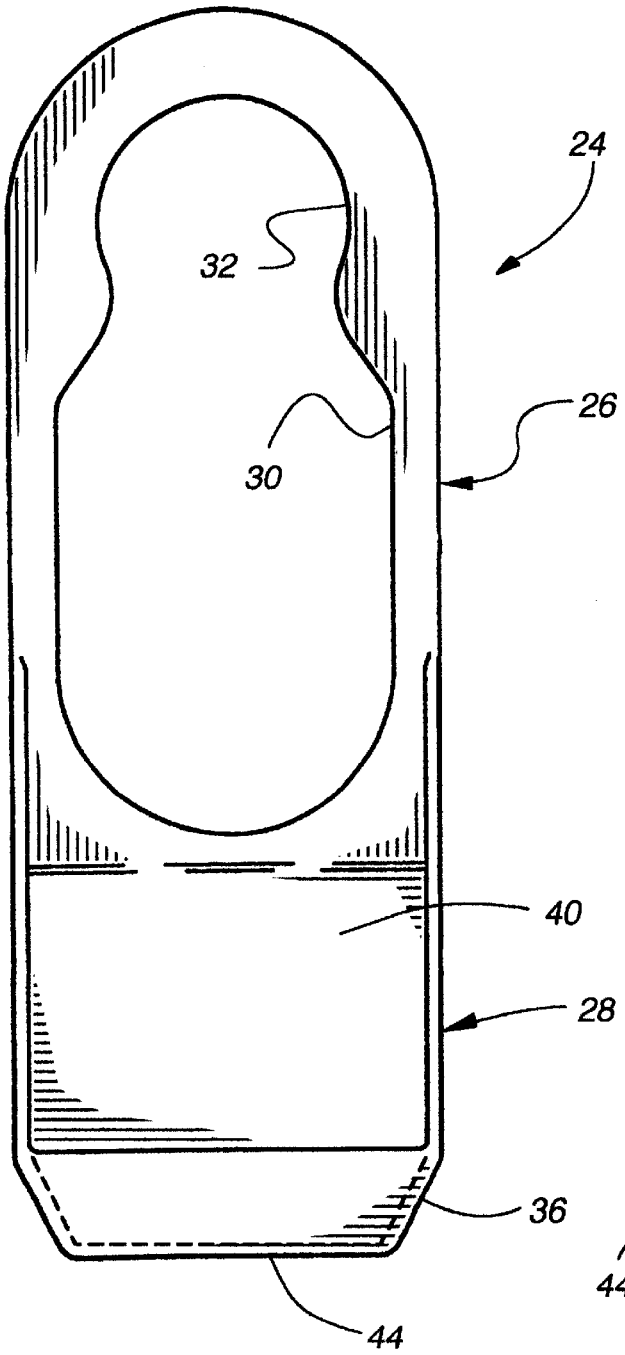
FIG. 2 is a front view of the boxed liquid drip catcher.
Figure 3:
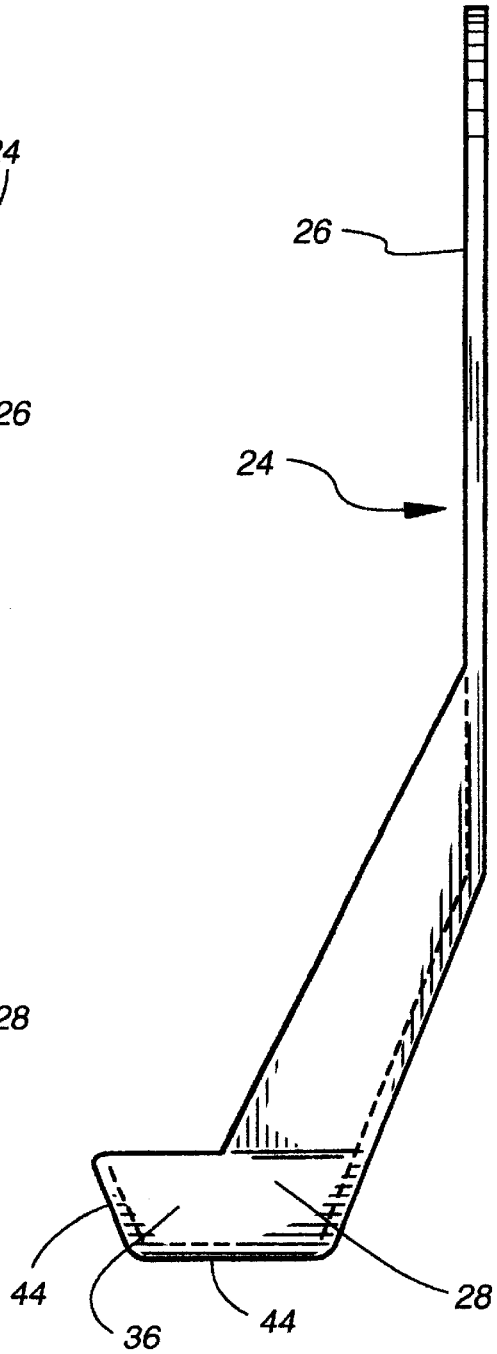
FIG. 3 is a side view of the boxed liquid drip catcher.

The hanger structure 26 of FIGS. 1, 2 and 3 form a wide slot 30 transitioning to a relatively narrow slot 32. The wide slot 30 is positioned near the bottom of the hanger structure 26, and the narrower slot 32 is positioned near the top end of the hanger structure 26. The wide slot 30 allows the hanger structure 26 to be positioned over the spout 20. When the hanger structure 26 is then moved downwardly with respect to the spout, the spout is moved along, relatively, the length of the wide slot 30 to the transition from the wide slot 30 into the narrow slot 32. The narrow slot 32 is sized to engage the sides of the spout 20 for secure positioning thereon, and to keep the hanging structure 26 from being pulled straight off the spout, either accidentally or intentionally. The sidewalls of the narrow slot 32 portion in the hanger structure 26 may engage corresponding annular grooves in the outer wall of the spout for secured positioning of the hanger structure 26 on the spout.

To remove the hanger structure 26 from the spout 20, the hanger structure is slid upwardly with respect to the spout 20 to remove the spout from the narrow slot 32 and transition it into the wide slot 30, at which time the hanger structure 26 can be pulled directly off the spout.

The top end of the narrow slot 32 is curved to engage the top of the spout 20 and cause the liquid catcher 24 to be oriented with the reservoir 28 directly below the spout.

The reservoir 28 of the liquid catcher shown in FIGS. 1, 2 and 3 has an upper section 34 and a lower section 36. The upper section 34 is attached to the bottom of the hanger structure 26 and slopes generally downwardly and away from the hanger structure. The lower section 36 is attached to the bottom of the upper section 34 of the reservoir and extends generally directly outwardly from the hanger structure. The upper section 34 defines sidewalls 38 formed at right angles to the bottom wall 40 of the sloped upper section. The bottom section 36 of the reservoir defines sidewalls 42 formed at outward angles to the bottom wall 44 of the bottom section 36. An end wall 46 formed along the bottom section connects the sidewalls 42 and forms a container like structure for catching, directing and storing the liquid drippings.

When liquid drips from the spout 20, the liquid drop travels directly downwardly from the spout and strikes the bottom wall 40 of the upper section 34 of the reservoir. The sloped bottom wall 40 then directs the drop to the bottom section 36 of the reservoir to collect the liquid drop therein. The sloped bottom 40 wall of the upper section 34 of the reservoir 28 minimizes the splashing that might occur from the impact of the liquid drop. The sidewalls keep what splashing does occur contained in the reservoir.

The sloped bottom wall 40 of the upper portion 34 of the reservoir 28 acts as the rear wall for the bottom portion 36 of the reservoir, and the volume of liquid able to be held in the reservoir is defined by the height of the sidewalls of the bottom portion of the reservoir. The outwardly sloped sidewalls and end walls form a cup for storing the liquid drippings.

The liquid drip catcher 24 can be rotated 360 degrees, or any portion thereof, around the spout 20. This is convenient if the liquid catcher needs to be moved out of the way to store the boxed-liquid container on a flat surface, or to empty the reservoir of the liquids contained therein without removing the drip catcher from the spout.

The narrower slot portion 32 of the hanger structure 26 can have straight sidewalls, as shown in the larger slot structure, or can have curved sidewalls, as shown in FIG. 2, to effectively snap onto the spout 20.

Figure 4:
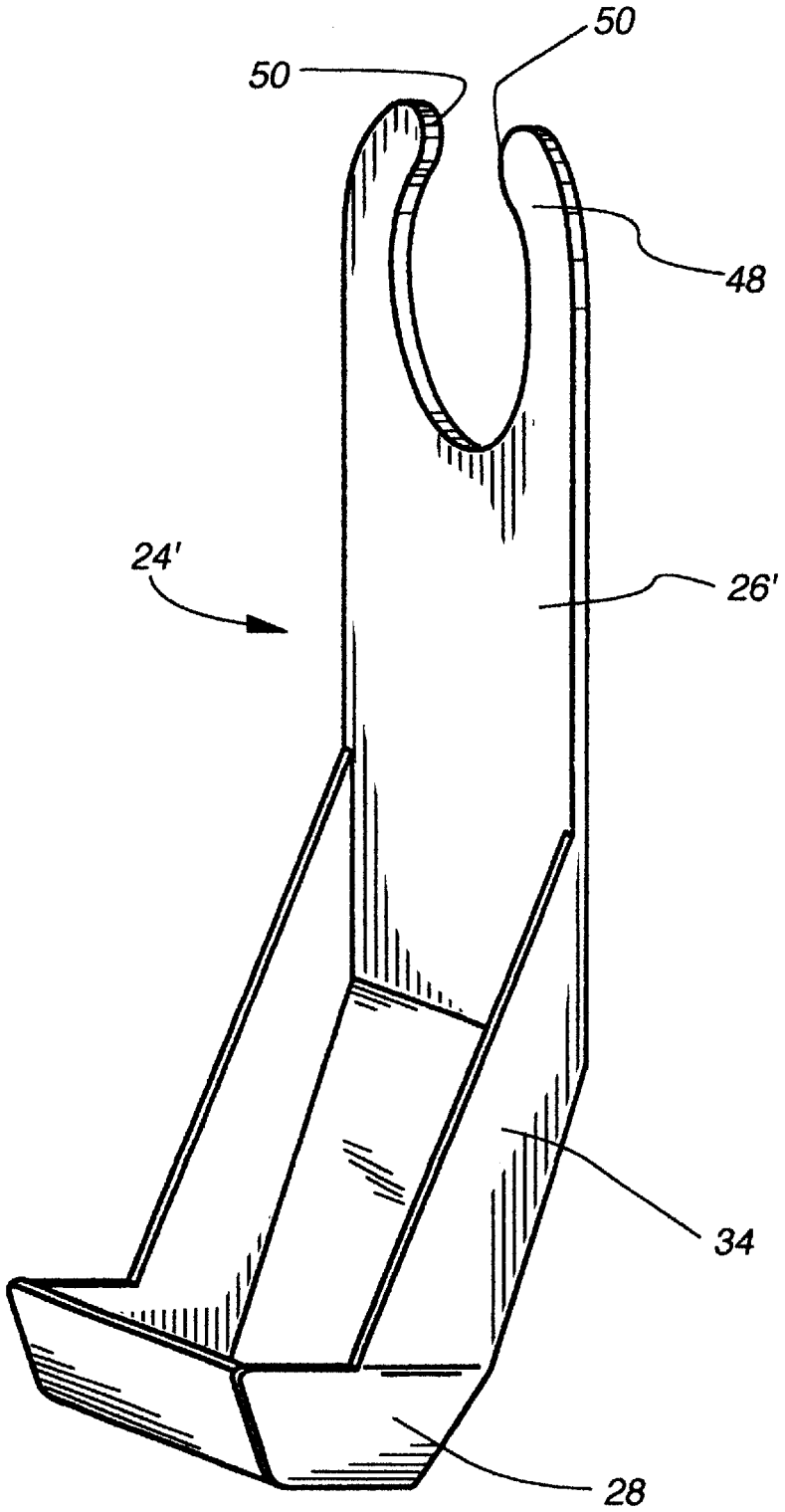
FIG. 4 is a perspective view of the liquid drip catcher showing a different embodiment of the mounting structure.

A second embodiment of the hanger structure can be seen in FIG. 4. In this embodiment, the reservoir 28 is the same as previously described with respect to FIGS. 1–3, but the hanger structure 26 is an inverted, generally U-shape formed by prongs 48 having inwardly directed tips 50. The prongs are resilient, and deform outwardly to pass by the spout 20, and spring back to their normal position to grip the spout and support the liquid catcher 24 thereon. The bottom portion 3 of the hanger structure 26 is solid, with the reservoir 28 attached thereto as described above.

It is important for the reservoir, particularly the bottom portion of the reservoir, to be spaced a distance below the spout to allow a container to be positioned directly underneath the spout in order to be filled. While the reservoir 28 in this first embodiment has been described with a sloped first portion 34 and a horizontally extending bottom portion, along with the advantages of that particular structure, the reservoir can be generally round, oval, or V-shaped, and can have straight or curved sides.

The material for construction of the invention may be plastic, composites, metal, ceramic, glass, or other like material suitable for this purpose. A thermoplastic is preferred, selected from polyethylene, polypropylene, polyamide, ABS, PVC, or other thermoplastics or combination of these and other thermoplastics.

Since the boxed-liquid container is typically positioned on the front of a shelf, the liquid drip catcher can extend below the bottom of the box 22, and thus below the shelf, to allow for the proper positioning of the reservoir 28 below the spout 20.

Figure 5:
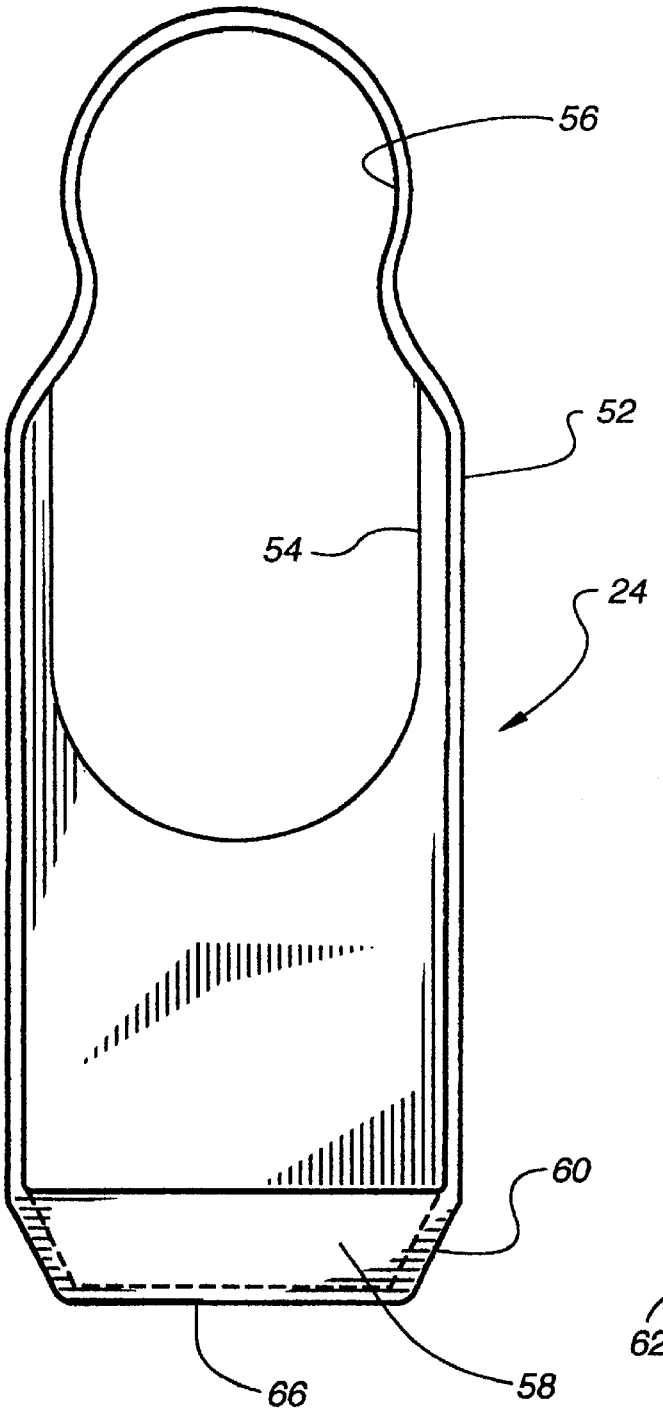
FIG. 5 is a front elevation view of another embodiment of the liquid drip catcher.
Figure 6:
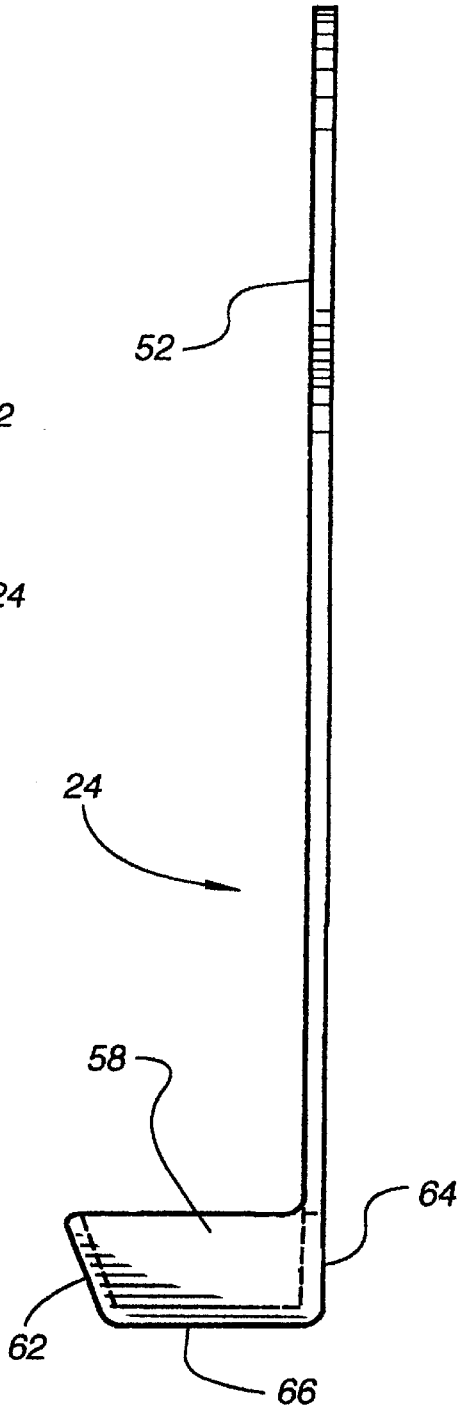
FIG. 6 is a side elevation view of the liquid drip catcher embodiment as shown in FIG. 5.

FIGS. 5 and 6 show a second embodiment of the drip catcher 24. The hanger structure 52 is similar to that of that shown in FIGS. 1–3, includes a lower relatively wide slot 54 and an upper relatively narrow slot 56. The spout is inserted through the hanger structure 52 in the wide slot 54 and the hanger structure is slid downwardly so the spout is positioned in the narrow slot 56 for secure placement on the spout. The reservoir 58 in this embodiment extends directly outwardly and substantially right angles to the hanger structure 52 and has outwardly sloping side 60 and front walls 62, with the back wall 64 being formed by the bottom end of the hanger structure 52. The reservoir 58 is positioned directly below the spout to catch liquid dripping therefrom. The liquid drips from the spout and impacts the bottom wall 66 of the reservoir 58 and collects therein. The bottom wall 66 of the reservoir is relatively flat and horizontal with respect to the vertically extending hanger structure 52. This embodiment of the drip catcher does not extend as far forward from the boxed-liquid container as the first embodiment shown in FIGS. 1–3, and thus takes up less space. The outwardly sloped front 62 and sidewalls 60 of the reservoir 58 help direct liquid drops impacting thereon towards the bottom wall 66 and minimizes splashing from the initial impact.

Figure 9:
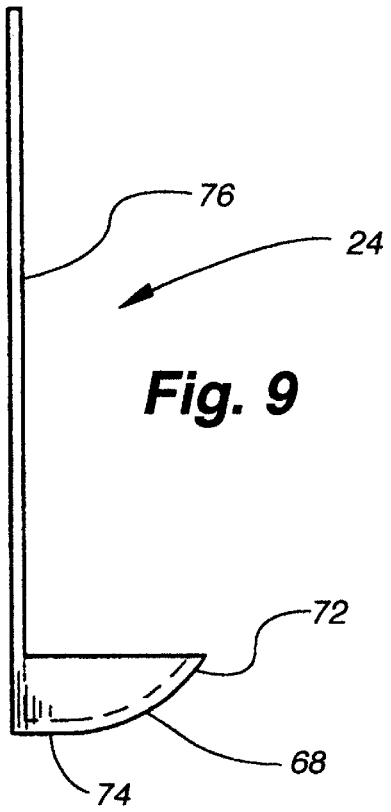
FIG. 9 is a side view of the embodiment shown in FIG. 7.
Figure 7:
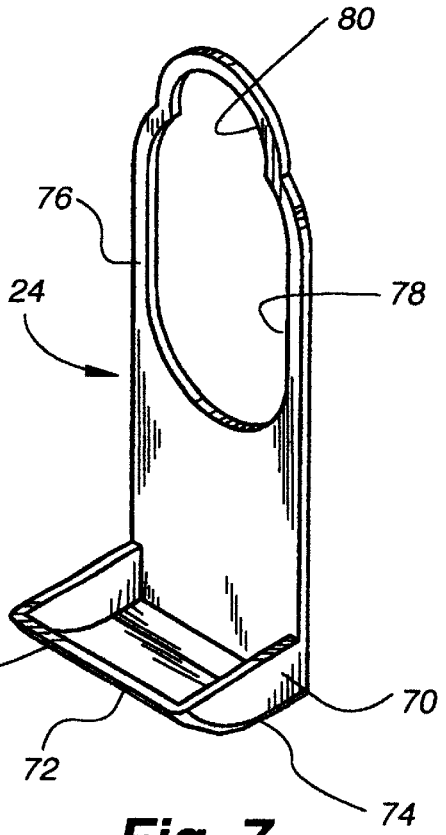
FIG. 7 is another embodiment of the liquid drip catcher.
Figure 8:
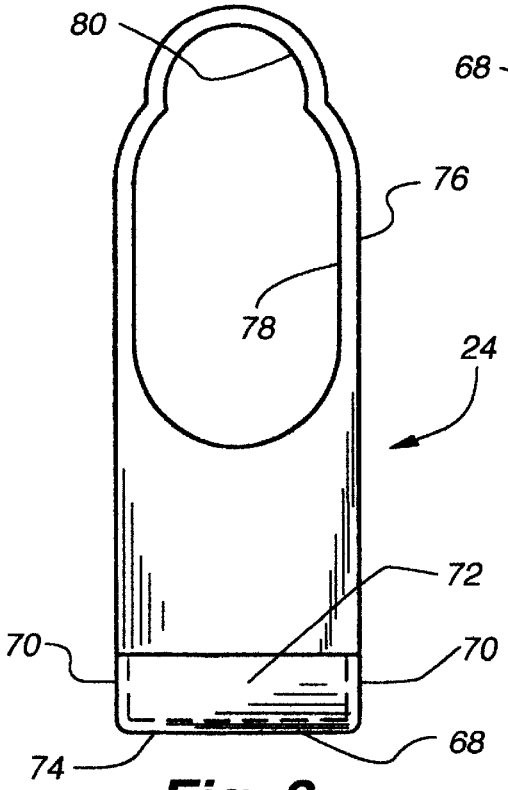
FIG. 8 is a front view of the embodiment shown in FIG. 7.

FIGS. 7–9 show a third embodiment of the present invention. The hanger structure 68 of this third embodiment is similar to that described with respect to FIGS. 5 and 6. The reservoir 68 is shaped with vertical sidewalls 70 and a curved front wall 72, with the curved front wall forming a portion of the bottom wall 74. The portion of the bottom wall 74 adjacent the bottom of the hanger structure 76 is horizontal and extending at substantially right angles to the hanger structure 76. A short distance away from the hanger structure the bottom wall 74 begins curving upwardly in a continuous curve and forms the front wall 72. Typically, the drips from the spout are centered from side to side in the reservoir and thus the majority of them hit the sloped front wall 72 and flow down into the reservoir 68. This allows the sidewalls 70 to be formed at right angles to the horizontal portion of the bottom wall 74, with only the front wall 72 needing to be curved to minimize splash and direct the liquid drippings into the reservoir 68. In this embodiment also the reservoir 68 is positioned directly below the spout and minimizes the forward extension of the liquid drip catcher 24 from the boxed liquid container. The hanger structure 76 of this embodiment includes the relatively wide lower slot portion 78 and the relatively narrower upper slot 80 portion for receiving and engaging the spout as described above.

The boxed liquid drip catcher, as described herein, is a separate device for removably mounting on the spout. However, it is contemplated that the drip catcher may be mounted in a permanent fashion during the construction of the box, or can be mounted in a manner allowing rotation of the drip catcher around the spout during construction of the box.

Presently preferred embodiments of the present invention and many of its improvements have been described with a degree of particularity herein. The previous descriptions are of preferred examples for implementing the invention. The scope of the invention should not necessarily be limited by the exemplary description, but as defined by the scope of the following claims.

I claim:

1. A liquid drip catcher for use on a boxed-liquid container having a spout, said catcher comprising:

a hanger structure attached to said spout;

a reservoir attached at a bottom of said hanger structure for collecting liquid drips from said spout, said reservoir includes an upper section and a lower section, said upper section attached to said bottom of said hanger and extending outwardly and downwardly therefrom;

said lower section extending outwardly from said upper section;

said upper and lower sections having walls; and wherein a drip from the spout impacts said upper section and is guided into said lower section.

2. A catcher as defined in claim 1, wherein:

said upper section of said reservoir has a sloped bottom wall for guiding said drip to said lower section.

3. A catcher as defined in claim 1, wherein:

said walls of said bottom section are sloped outwardly.

4. A catcher as defined in claim 1, wherein:

said hanger structure includes a top end defining prongs forming a generally U-shape to resiliently grip said spout and support said catcher on said spout.

5. A catcher as defined in claim 1, wherein said catcher is rotatable around said sprout.

6. A catcher as defined in claim 1, wherein:

said hanger structure includes a slot having a first end and a second end, said first end being wider than said second end, said first end for placing over said spout and said second end for engaging said spout to support said catcher on said spout.

7. A catcher as defined in claim 1, wherein:

said reservoir includes a bottom wall, front wall, opposing side walls and a rear wall; and said side walls and fronts wall extend at an angle from said bottom wall.

8. A catcher as defined in claim 1, wherein:

said reservoir includes a bottom wall, front wall, opposing side walls and a rear wall; and said front wall curves outwardly and upwardly from said bottom wall.

* * * * *